US006695002B1

(12) United States Patent
Trangsrud

(10) Patent No.: US 6,695,002 B1
(45) Date of Patent: Feb. 24, 2004

(54) OUTSIDE DROP FOR MANHOLE

(75) Inventor: Julian P. Trangsrud, Northfield, MN (US)

(73) Assignee: Royal Environmental Systems, Inc., Stacy, MN (US)

( * ) Notice: Subject to any disclaimer, the term of this patent is extended or adjusted under 35 U.S.C. 154(b) by 0 days.

(21) Appl. No.: 10/421,181

(22) Filed: Apr. 23, 2003

(51) Int. Cl.[7] ..... E29D 29/12

(52) U.S. Cl. ..... 137/372; 137/343; 137/362; 248/65; 248/74.4; 52/21

(58) Field of Search ..... 137/343, 363, 137/372; 52/20, 21; 248/65, 74.1, 74.4

(56) References Cited

U.S. PATENT DOCUMENTS 4,243,068 A 1/1981 Sugda et al. ..... 137/363
4,566,483 A 1/1986 Ditcher ..... 137/372
5,299,596 A 4/1994 D'Alessandro ..... 137/363

*Primary Examiner*—A. Michael Chambers
(74) *Attorney, Agent, or Firm*—Nikolai & Mersereau, P.A.

(57) ABSTRACT

A collar for supporting or protecting pipes on an outside drop adjacent a manhole is provided. A plurality of stacked collar sections can protect pipes comprising the outside drop. Alternatively a plurality of collar segments having a circular wall within can form the pipe integrally with the collar. The collars can protect riser pipe sections or elbow piper sections. The collars may be split for ease of installation around pipes and fastened together around the pipe. The collars are easily attached to the manhole by drilling a hole into the manhole at designated places and using bolts through tabs on the collars to hold the collar in place adjacent the manhole. The collars can have several different standard heights and be stacked to the desired height of the manhole. Pipes having riser sections or elbow sections can have protective collars.

24 Claims, 14 Drawing Sheets

OUTSIDE DROP FOR MANHOLE

BACKGROUND OF THE INVENTION

1. Field of the Invention

This invention relates to a collar attached to the side of a manhole to protect an outside drop adjacent the manhole, and alternatively for the plurality of collars to form a protected outside drop.

2. Description of the Related Art

When an outside drop is used adjacent a manhole the outside drop is subject to damage and subsequent leaks by rocks and other fill material and due to shifting of the ground, the weight of the pipes and other factors. It is desired to have a protective collar around the drop pipe.

Currently protective collars are very heavy which makes them difficult and expensive to transport and install. The protective collars in use need to be set on a solid base as part of the base of the manhole, which makes the manhole itself heavier, more expensive and more difficult to install in the ground. The collars surround a drop pipe must be made the correct size to support the drop pipe, collars and connections, particularly at the top of the outside drop where there is a T connection and at the bottom of the outside drop where there is an elbow pipe connection. Since riser collars are made of concrete they are very heavy and require tools to lift the collar parts into place. Since the riser collars are not fastened to the manhole they may have gaps between the manhole and the collar or may shift way from the manhole.

Outside drop pipes are generally made from ductile iron, which is heavy, expensive and hard to work with. Plastic pipe is lighter, costs less, is easier to connect and easier to work with. However plastic pipe is more subject to damage and needs protection.

SUMMARY OF THE INVENTION

A lightweight easy to install protective collar is attached to the side of a manhole to surround an outside drop while securing the outside drop in place adjacent the manhole. The protective collar can be one or more sections separated by some distance or the sections can be stacked to form a continuous protective barrier. The collar can form around an outside drop pipe or the collars can have an opening therein to form the outside drop pipe inside the collar. The diameters of the pipes on the outside drop can be standardized by using expansion or reduction pipes at the top or bottom of the manhole so that only one size protective collar needs to be used. Similarly with a combination internal pipe and collar only one size internal pipe needs to be produced when expansion and contraction collar sections are used. The collars can fit over expansion or reduction pipes and over elbow pipes. The collars with integral pipes can fit around expansion or reduction internal pipes and elbow pipes, and can have expanded portions for fitting over pipe coupling segments and flanges. The collars for fitting over pipes can be split radially or perpendicular to radially and assembled around the pipes. The collars for fitting over pipes can have expanded portions for fitting over pipe coupling segments and flanges.

Tubes molded into collars and extending between opposing walls add strength to the collars, which are molded as hollow parts. To add weight and stability an aperture in the top of the collars can be used to fill the collars with sand or other material to increase the weight and impact absorbing ability of the collars. Similarly apertures in the sides of the collars can let water in if the water table rises and let water out when the water table declines.

OBJECTS OF THE INVENTION

It is an object of the invention to provide a lightweight outside drop collar.

It is an object of the invention to provide an easy to assemble outside drop collar.

It is an object of the invention to provide a low cost outside drop collar.

It is an object of the invention to provide an outside drop collar that attaches to a manhole.

It is an object of the invention to provide an outside drop collar that does not need a base on the manhole.

It is an object of the invention to provide a combination collar and outside drop pipe for a manhole.

It is an object of the invention to provide size adaptors for connecting pipe to the outside drop to standardize the size of the outside drop collar sections.

It is an object of the invention to provide collar sections in standard heights to fit manhole heights.

It is an object of the invention to provide an outside drop collar with apertures for letting water in or out of the collar.

It is an object of the invention to provide an outside drop, which can be filled to add weight and strength to the outside drop collar.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
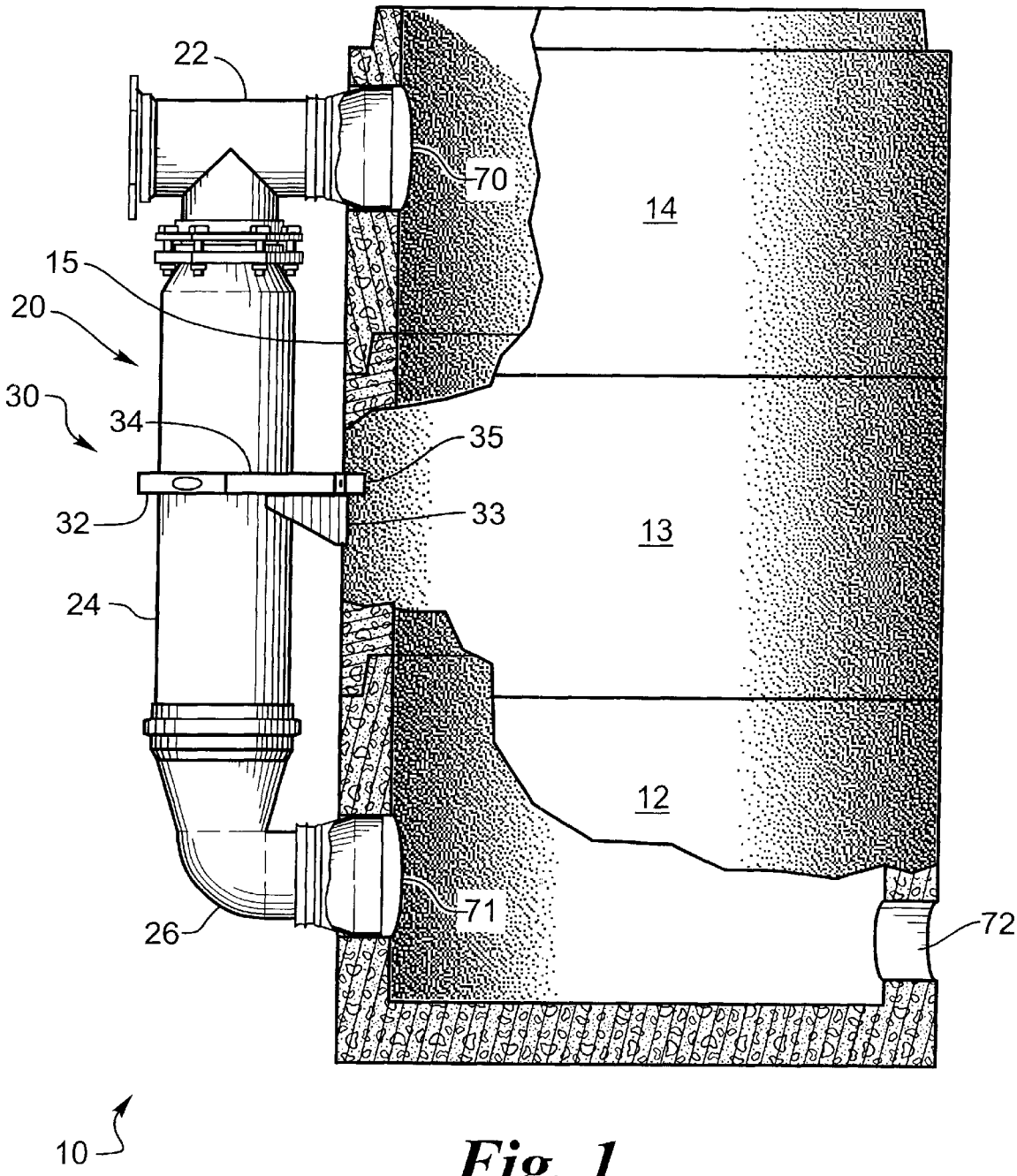
FIG. 1 is a side cross sectional view of an outside drop adjacent a manhole with a single collar section.

A typical manhole 10 may be one long molded concrete pipe with openings 70, 71, 72 for outside drop pipes to connect to the manhole 10 at the top 70 and bottom 71 and for outflow 72. The manhole may come in sections as in FIG. 1, which are assembled to form the manhole 10. In FIG. 1 manhole 10 has three sections, a bottom section 12, a middle section 13, and a top section 14. In order to facilitate working in the manhole 10 an outside drop 20 is used to add waste flowing into the sewer system. The outside drop 20 has a T connector 22 at the top, a riser section 24 and an elbow 26 at the bottom. Typically the outside drop 20 is made of ductile iron. After the manhole 10 and outside drop 20 are installed in a hole in the ground, filler materials such as rocks, sand and soil are placed in the hole to fill in the empty space surrounding the manhole 10 and outside drop 20. If the outside drop 20 has no supports it can by its own weight move relative to the manhole 10 which may cause leaks at the joints between the T connector 22 and the riser section 24, or between the riser section 24 and the elbow 26, or the elbow and the manhole 10. The outside drop 20 may also be struck by rocks in the filler material and be moved or damaged. The outside drop riser section 24 may be an assembly of two or more pipes depending on the height of the manhole 10. The additional connections for multiple section risers are also subject to leaks at the joints if the outside drop 20 is moved or damaged. Over time ground shifts due to settling, vibrations, drainage, water tables, frost, subsidence, and other geological or man made conditions may move the outside drop 20 relative the manhole 10.

Figure 2:
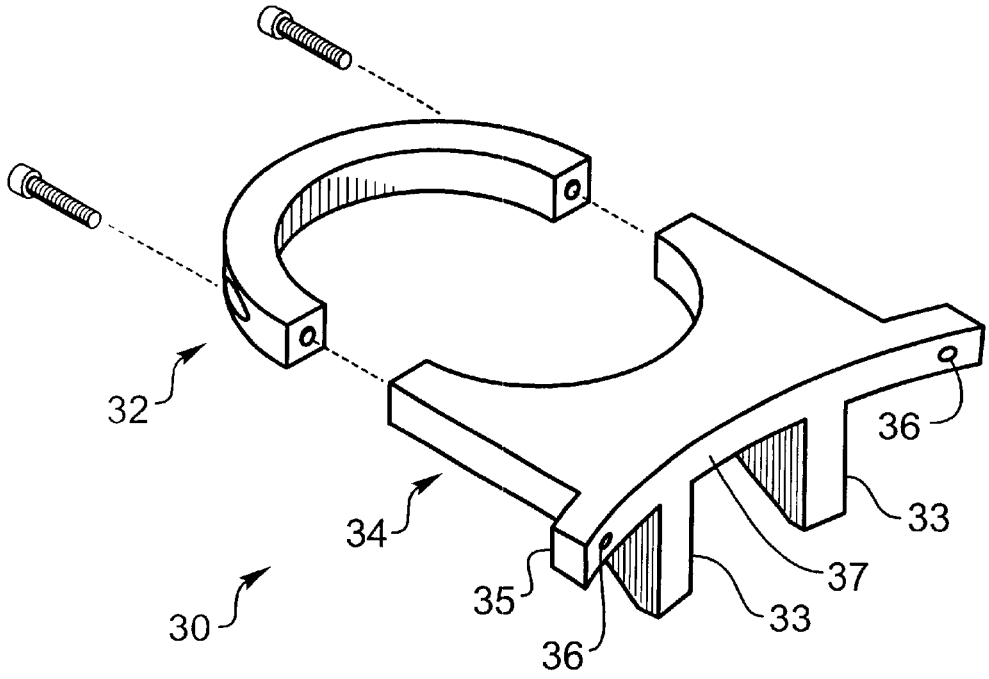
FIG. 2 is a perspective view of a collar section.
Figure 3:
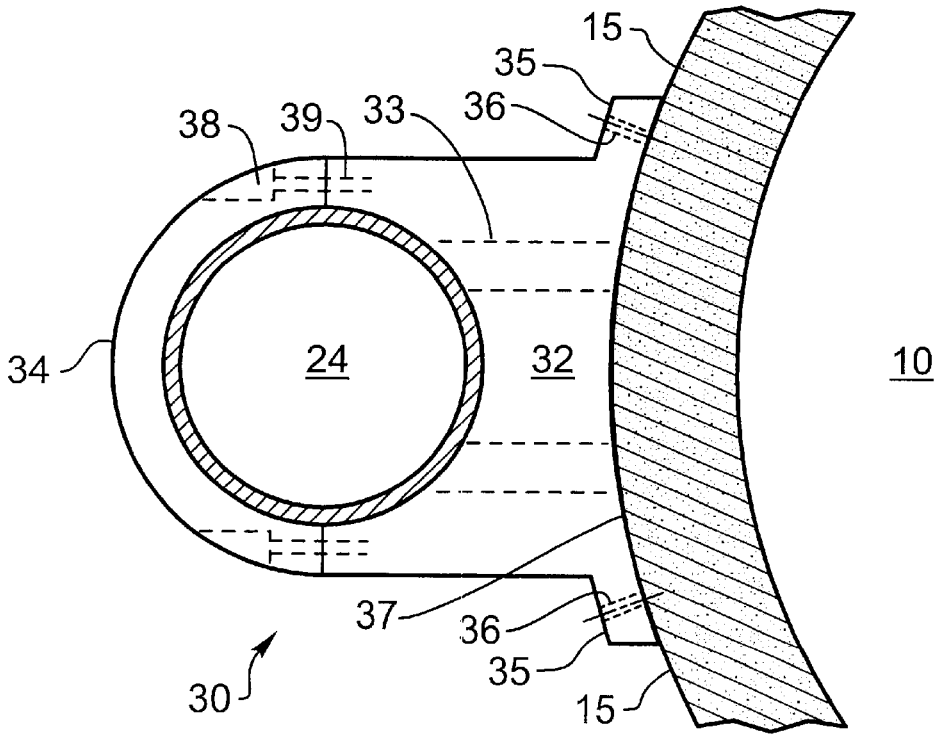
FIG. 3 is a top view of a collar section.

In order to protect the outside drop 20 and attach it to the manhole 10 for stability, a riser collar 30 may be used. FIGS. 2 and 3 show a riser collar 30 having a front portion 32 for attachment to the manhole 10 and a rear portion 34 for attachment to the front portion 32. In assembling the outside drop manhole in the ground the manhole 10 is inserted into the ground and then the outside drop 20 is attached. The riser collar 30 is then attached to the riser 24 to keep the outside drop 20 in place relative the manhole 10. The riser collar 30 has a curved attachment wall 37 for mating with the outer face 15 of the manhole 10. Tabs 35 with bolt apertures 36 are for attaching the riser collar 30 to the manhole 10 with bolts. A drill can be used to drill a hole in the manhole 10 at the proper locations for attachment of the front collar portions 32 and then bolts inserted through apertures 36 in tabs 35 to secure the front collar portions 32 to the manhole 10. The rear portion of the collar 34 then mates with and is bolted to the front collar portion 32 by bolts extending through the bolt aperture 38 in the rear collar portion 34 to the bolt receiving section 39 of front collar portion 32. The riser collar 30 is thus secured to the manhole 10 and surrounds and protects a portion of the outside drop 20 on riser section 24 such that it secures the riser section 24 in place and protects it from damage in the area the collar surrounds. For short collar sections the riser collar 30 may have support portions 33 for engaging the outer face 15 of manhole 10 for greater stability.

For ease of construction the front collar portion 32 may be attached to the manhole 10 or manhole portion 12, 13, or 14 above ground. The outside drop 20 may then be added in the ground and the rear collar portion 34 assembled last. Alternatively any order of assembly may be used.

Figure 4:
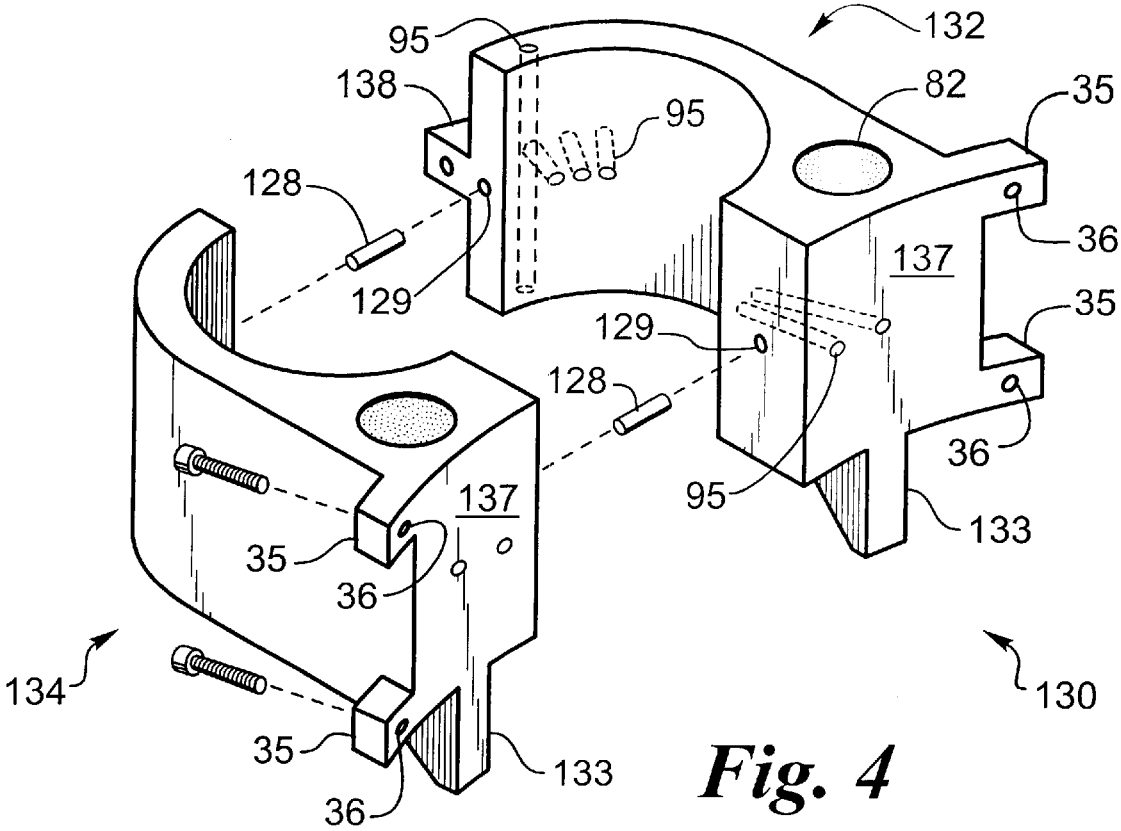
FIG. 4 is a perspective view of a radially split collar section.
Figure 5:
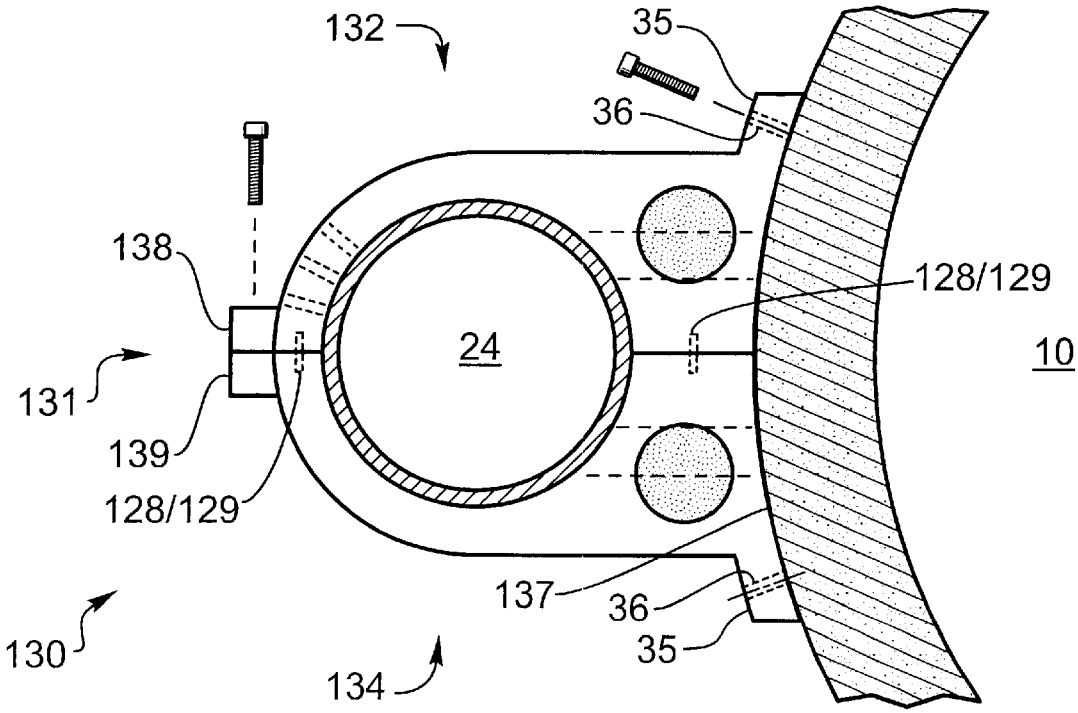
FIG. 5 is a top view of a radially split collar section.

The collar may be split radially as in FIGS. 4 and 5 where radially split riser collar 130 has right collar portion 132 and left collar portion 134. The riser 24 can be installed in the outside drop 20 and the riser collar 130 can be installed around the riser 24 by attaching the right collar portion 132 on the manhole 10 by bolts thought apertures 36 in tabs 35 and then attaching the right collar portion 134 to the manhole 10 by bolts though apertures 36 in tabs 35. As before boltholes are drilled in the manhole 10 in the appropriate places. A support portion 133 may be used to help stabilize the riser collar 130 on the manhole 10. The right portion of the collar 132 and the left portion of the collar 134 can have an engagement mechanism 131 such as a guide pin 128 and aperture 129 arrangement to guide the two halves 132, 134 of the radially split riser collar 130 together and hold them in place. There may also be a flange 138 on right collar portion 132 and a flange 139 on left collar portion 134 for placing a bolt or other fastener through to lock the two halves of the radially split riser collar 130 together. It is easier to install the radially split riser collar 130 than riser collar 30 around an outside drop 20 already installed on the manhole 10 because the riser collar 30 has to be installed between the manhole 10 and the outside drop 20 which may be difficult once the outside drop 20 is installed.

Figure 6:
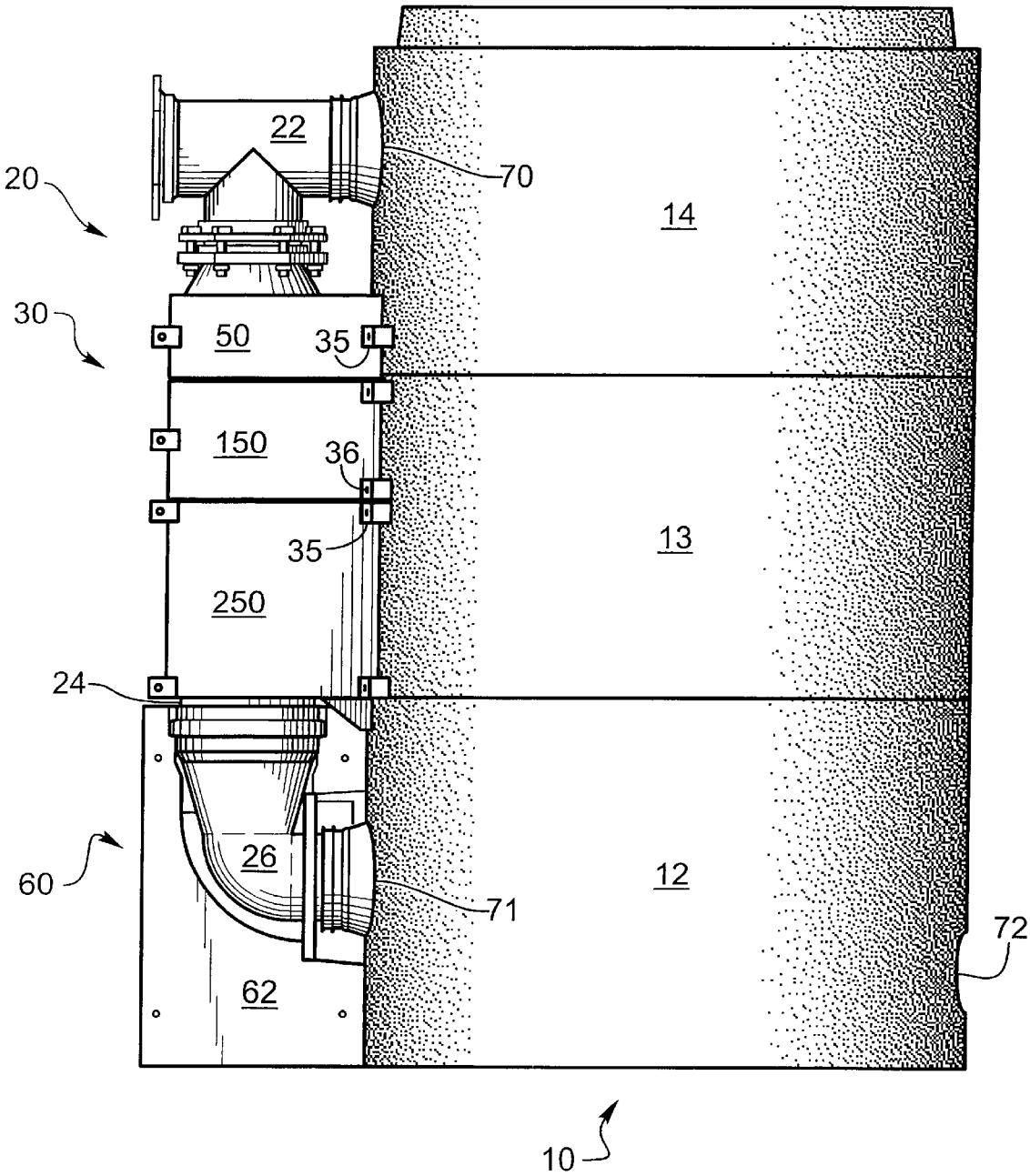
FIG. 6 is a side cross sectional view of an outside drop adjacent a manhole with a collar enclosing the riser and elbow.

Rather than have one or two sections of protective sections of riser collars 30 or 130 along the riser 24 the collars can be installed to protect the entire length of the riser 24. As shown in FIG. 6 riser 24 has three different length sections of stacked riser collars 50, 150 and 250, which completely surround and protect the riser 24 and attach the riser 24 to the manhole 10.

Figure 7:
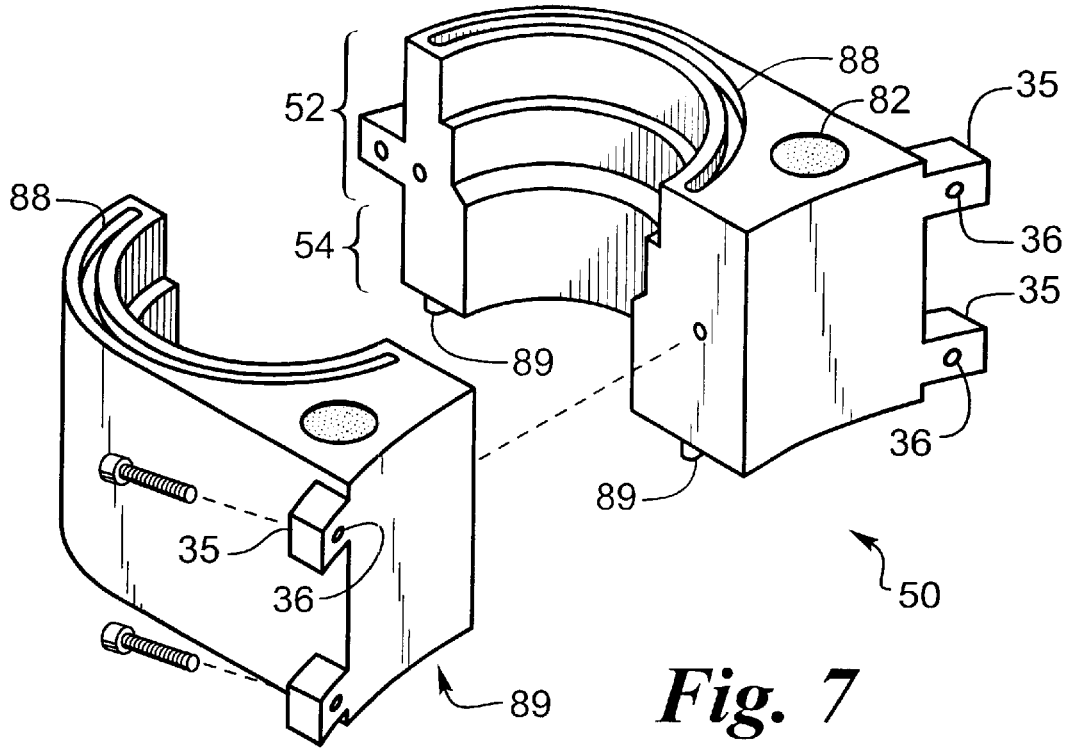
FIG. 7 is a perspective view of a short section of a riser collar having a radial split.
Figure 8:
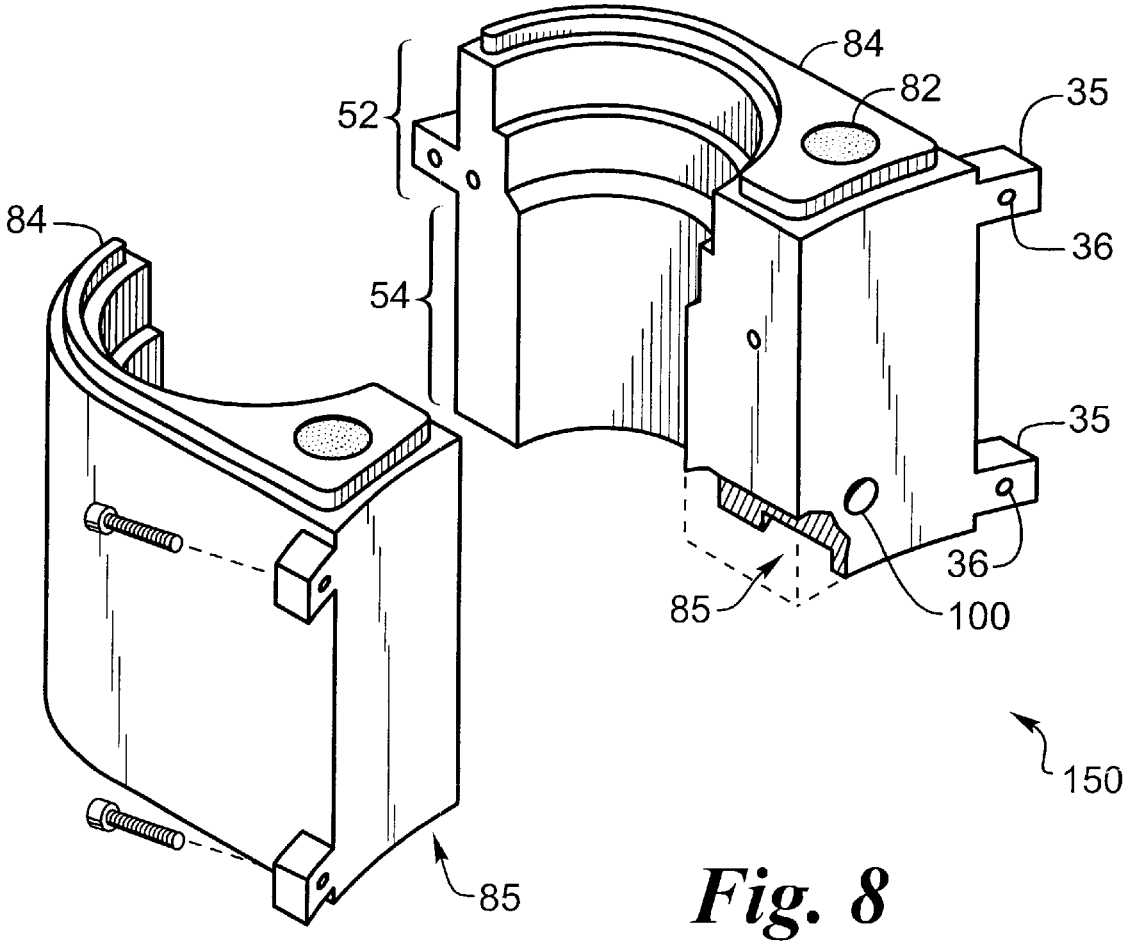
FIG. 8 is a perspective view of a medium section of a riser collar having a radial split.
Figure 9:
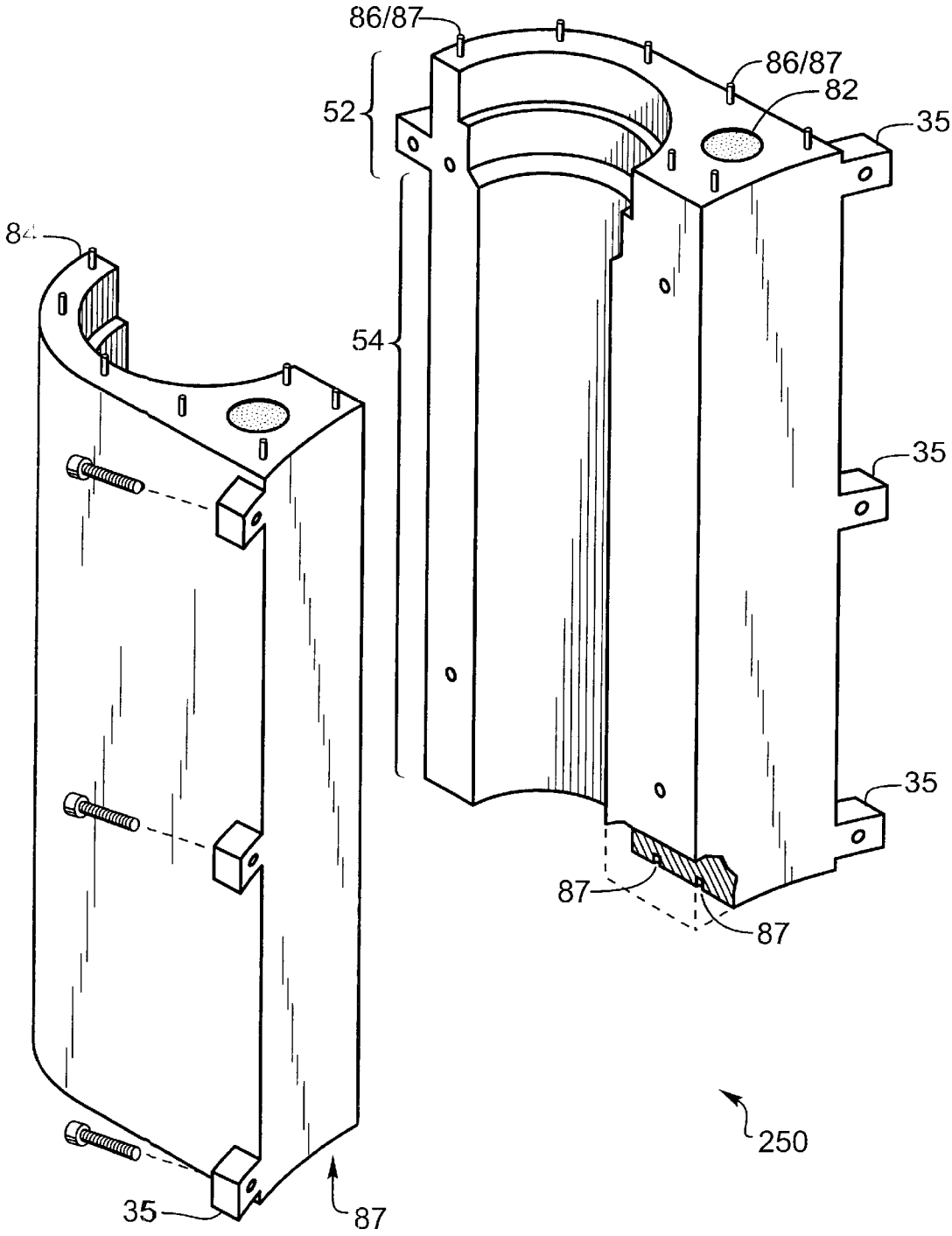
FIG. 9 is a perspective view of a long section of a riser collar having a radial split.

In the embodiments shown in FIGS. 7, 8 and 9 the riser collars 50, 150 and 250 respectively are radially split as is riser collar 130 but alternatively may be split in half as riser collar 30 is. Further the riser collars 50, 150 and 250 are shown with a pipe coupler engaging portion 52 and a pipe engaging portion 54. The pipe coupler engaging portion 52 fits over pipe couplings between riser 24 sections or between riser 24 sections and connections to T connectors 22 or elbow connectors 24. The short length riser collar 50 is shown in FIG. 7 with tongue 89 and groove 88 connections between the top and bottom of like kind collar sections for stacking them. The medium length riser collar 50 is shown in FIG. 8 with a nesting flange 85 over an interior raised section 84 for stacking the collar sections. The long length riser collar 250 is shown in FIG. 9 with a pin 86 and aperture 87 method of stacking the riser collars. The riser collar sections may have a pipe engaging portion 52, or not as shown for riser collars 30, 130. For the longer the riser collar sections more tabs 35 are used for bolting the collars to the manhole 10.

As can be readily understood any method of stacking the collar sections together can be used and would be uniform throughout the stack.

The riser collars 30, 50, 130, 150, 250 are preferably made of a molded plastic. The inside of the collars are hollow making the riser collars lightweight and easy to work with. In order to simulate the heavier concrete collars of the prior art and afford more protection for the riser 24, the collars can be filled with sand after installation to make them heavy and less prone indentation and damage. An aperture 82 in the top of the collar can be used to add sand or other filler material to the riser collar once it is installed. The riser collars 30, 50, 130, 150, 250 may also have apertures 81 in the sides of the collars at the base of the collar for water to enter and leave. As the water table in the ground rises and falls it may be beneficial to let water in so that the buoyancy of the water will not stress the collar on the manhole. Similarly if water enters the riser collar it may be beneficial to have an outlet so that the water can escape reducing the weight of the riser collar on the manhole.

Figure 10:
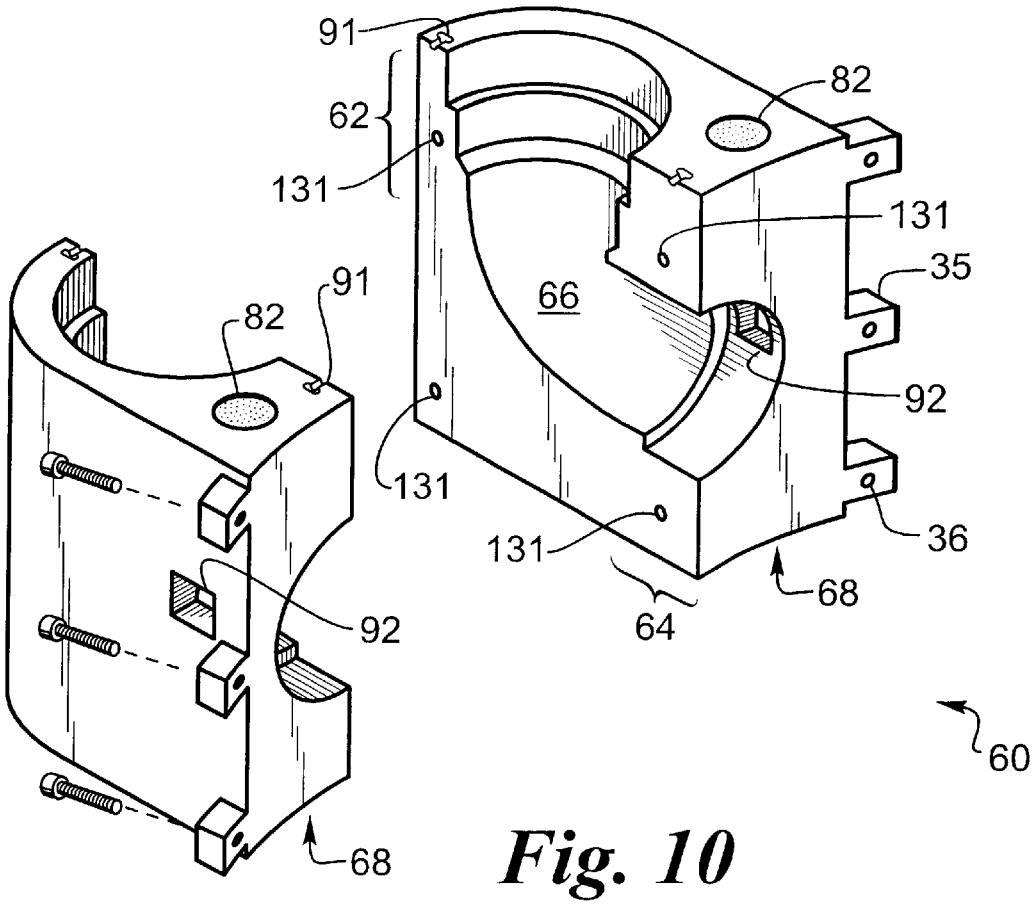
FIG. 10 is a perspective view of an elbow collar having a radial split.
Figure 11:
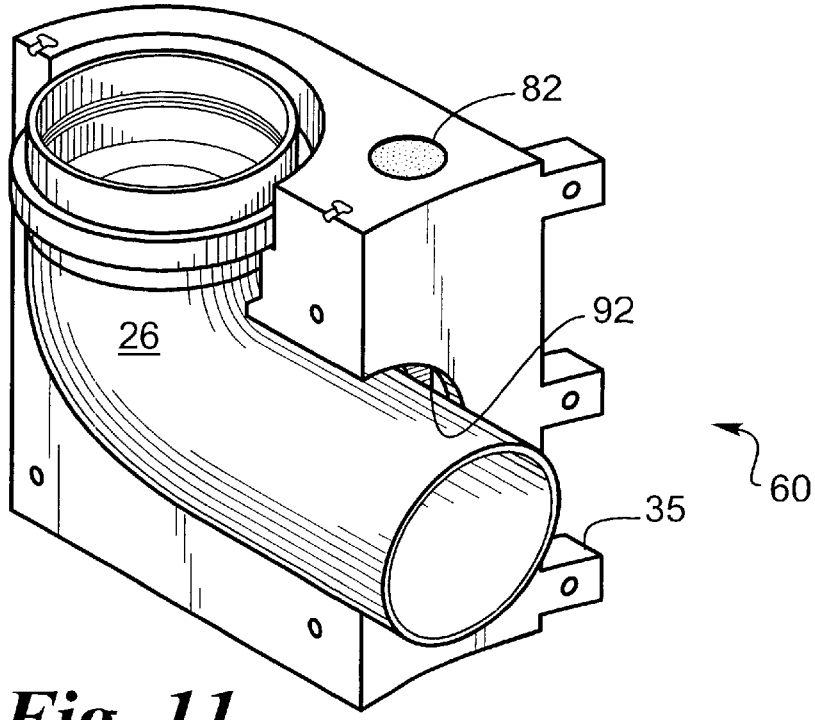
FIG. 11 is a perspective view of an elbow collar having a radial split containing an elbow pipe.

To increase the protection afforded to the outside drop 20, elbow collar sections 60 can be added to protect the elbow 26 of the outside drop 20 and to support the stack of riser collars 50, 150, 250 protecting riser 24. As shown in FIGS. 10 and 11 the elbow collar 60 has a base 68, which is flat and is placed on the ground next to the base of the manhole 10. During construction the base of the hole is leveled so that the base 62 of the manhole 10 and the base 68 of elbow collar 60 are at the same level. The elbow collar 60 has an opening 92 to access the boot clamp in boot clamp section 64 for tightening or loosening the boot clam p on the elbow 26 for connecting it to a pipe entering th e manhole 10 at aperture 71. The elbow collar 60 has a coupler engaging portion 62 and an elbow enclosing portion 66. The halves of the elbow coupler 60 can be attached to each other by an engagement mechanism 131. A keyhole shaped aperture 91 and corresponding key can be used to connect the elbow collar 60 to the adjacent elbow collar to surround a pipe. The elbow collar 60 may be filled with sa nd through aperture 82 to make the elbow collar 60 stronger heavier and more protective of elbow 26. An aperture for allowing water in and out may also be placed on the elbow collar 60. Tabs 35 having bolt apertures 36 are used to attach the elbow collar 60 to the manhole 10. Engagement mechanisms 131 are used to secure the halves of the elbow collar 60 together. The engagement mechanism may be bolts though apertures.

A T connector 22 is near the top of the manhole which makes it easily accessible and it generally does not need the same kind of protection as the riser 24 and the elbow 26 however a T collar is also possible for the T connector.

Figure 12:
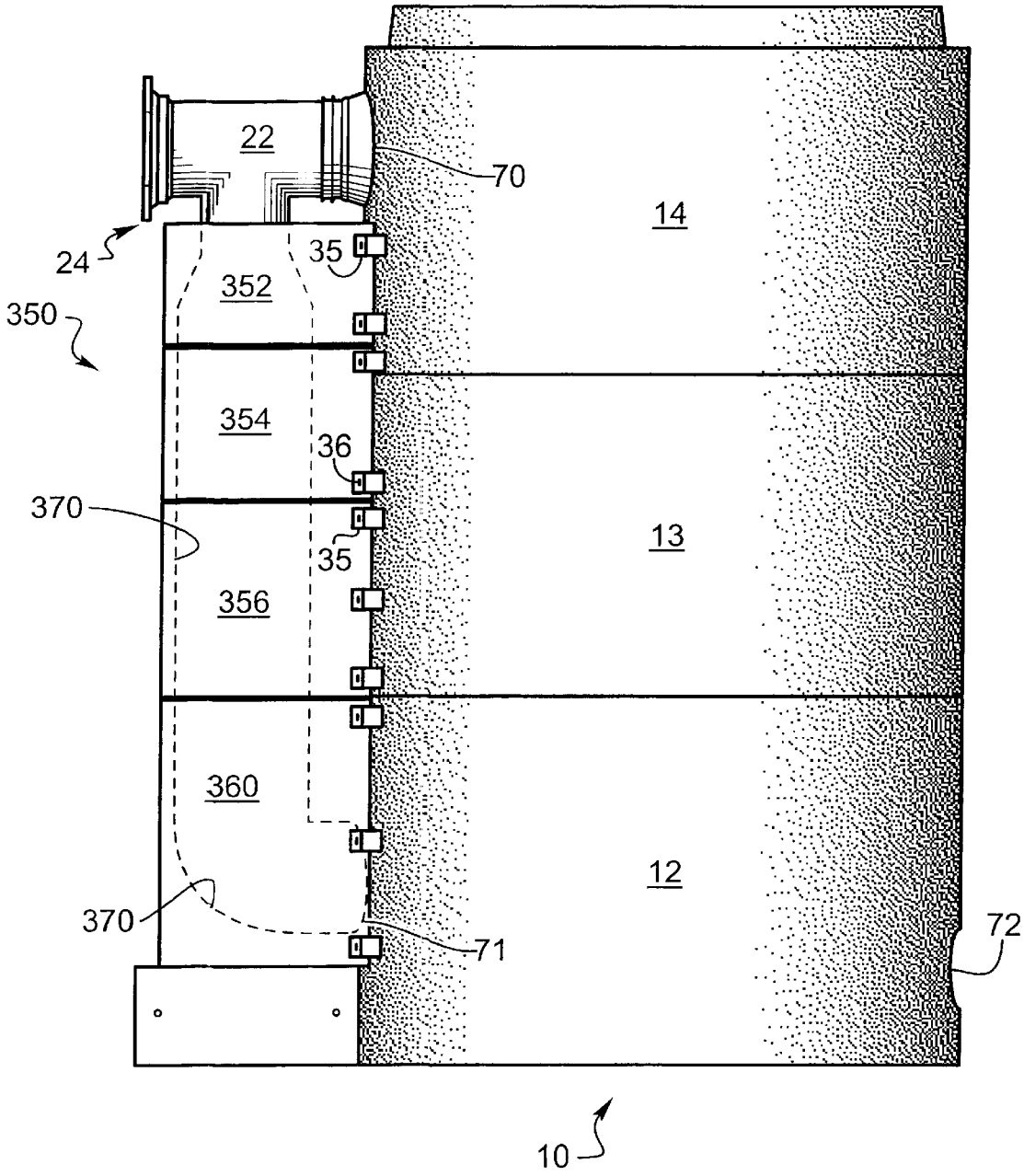
FIG. 12 is a side cross view of an outside drop adjacent a manhole with multiple riser sections having integral inside pipe walls.

In an alternative embodiment as shown in FIG. 12 protective risers 350 having the pipe walls 370 on the inside can replace the combination of rises 24 and protective collars 50, 150, 250 covering the entire length of the riser 24. The protective rises 350 can come in short length sections 352, medium length sections 354, and long length sections 356.

Figure 13:
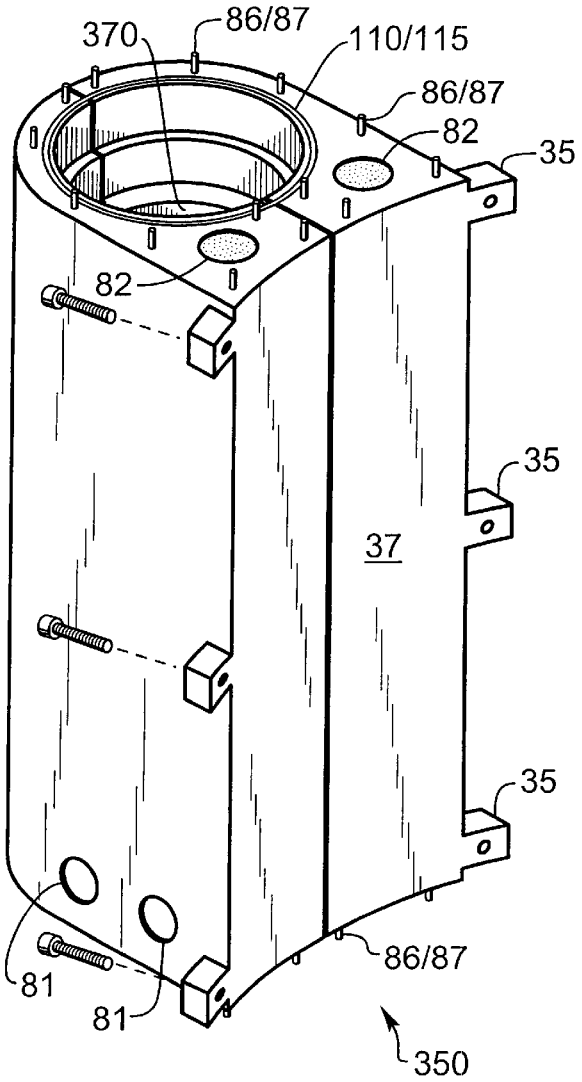
FIG. 13 is perspective view of a riser section having integral inside pipe walls.
Figure 14:
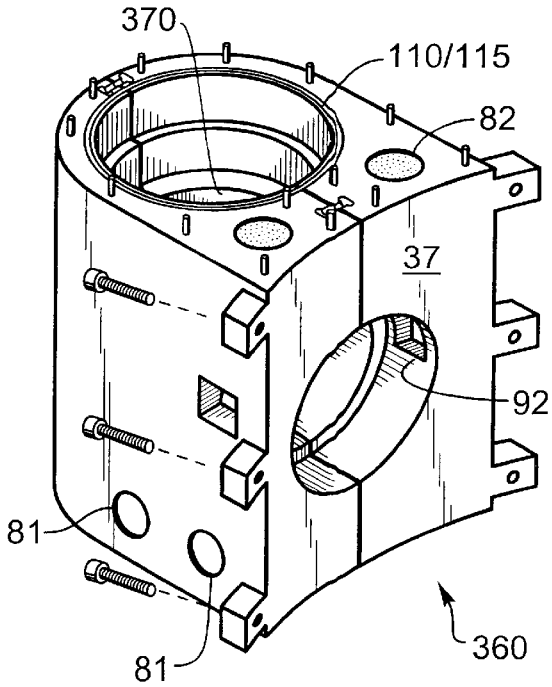
FIG. 14 is a perspective view of an elbow section having integral inside pipe walls.

The protective risers 350 are preferably molded as one piece so the inside wall 370 is continuous. The inside wall 370 is protected by the space between the inside wall and the outside of the protective riser to provide a double hull for the fluid flowing in the protective riser 350. The top and bottom of the protective riser 350 may have pipe like couplings to connect to T couplings, elbows, or other pipes. The protective riser shown in FIG. 13 can come in different lengths as indicated in FIG. 12 with protective risers 352 354 and 356. The protective rises may have an o-ring 110 in an o-ring groove 115 between sections of protective risers 352, 354, 356, or between protective riser 350 and other parts such as a protective elbow 360 with an inside pipe wall 370 as shown in FIG. 14. As with the split riser collars 50, 150, 250 and split elbow collars 60 the protective risers 350, 352, 354, 356, and protective elbows 360 may have apertures 82 for adding sand or apertures 81 for draining water. Further the protective risers 350 and protective elbows 360 can have the same connective means for stacking the sections as the split riser collars 50, 150, 250 and split elbow collars 60 shown above. The protective risers 350 and protective elbows 360 are also connected to the manholes by bolts through apertures 36 in tabs 35.

Figure 15:
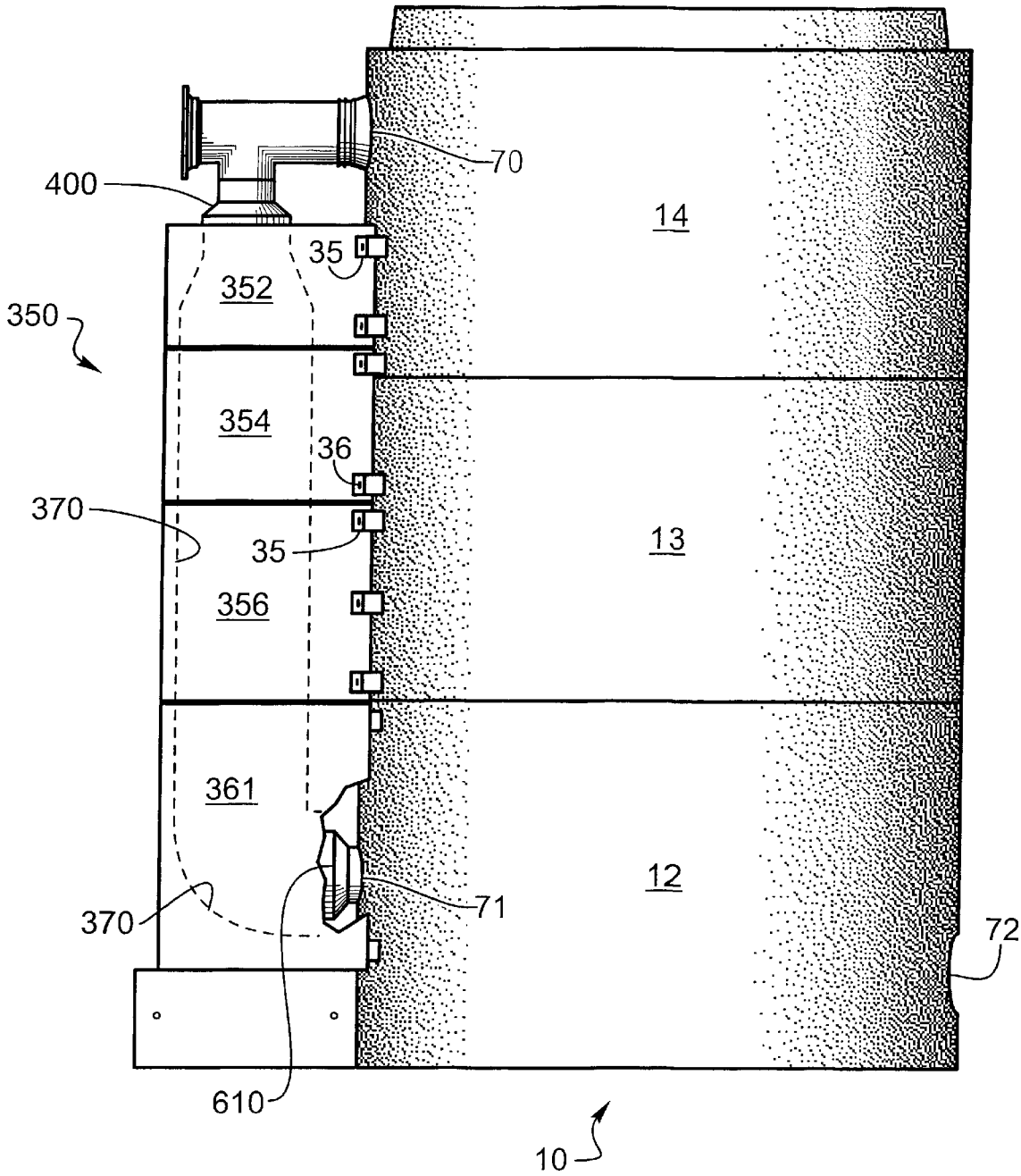
FIG. 15 is a side view of a manhole with the riser having an expanding T adaptor and the elbow having a reducing adaptor.
Figure 16:
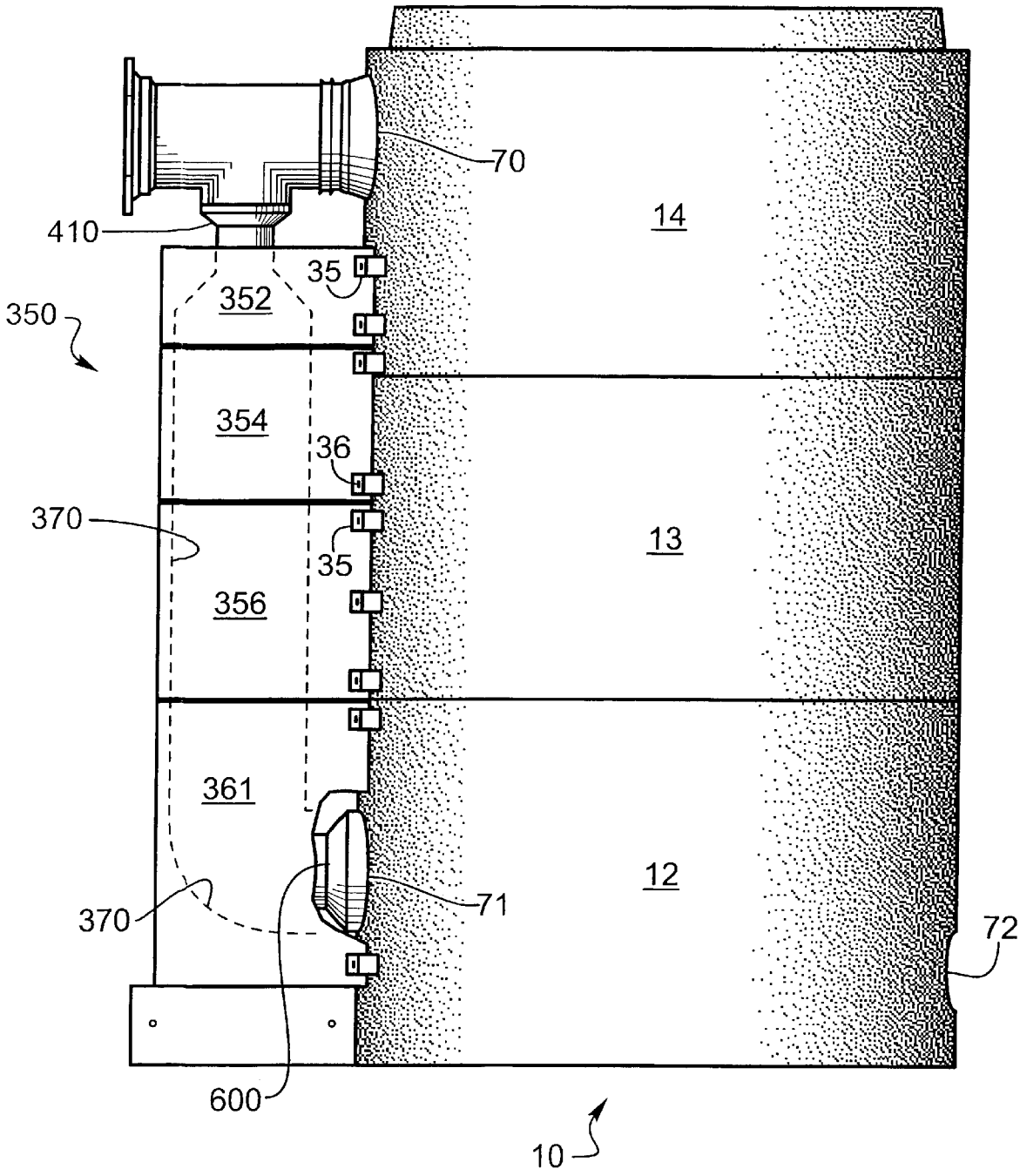
FIG. 16 is a side view of a manhole with the riser having a reducing T adaptor and the elbow having an expanding adaptor.
Figure 22:
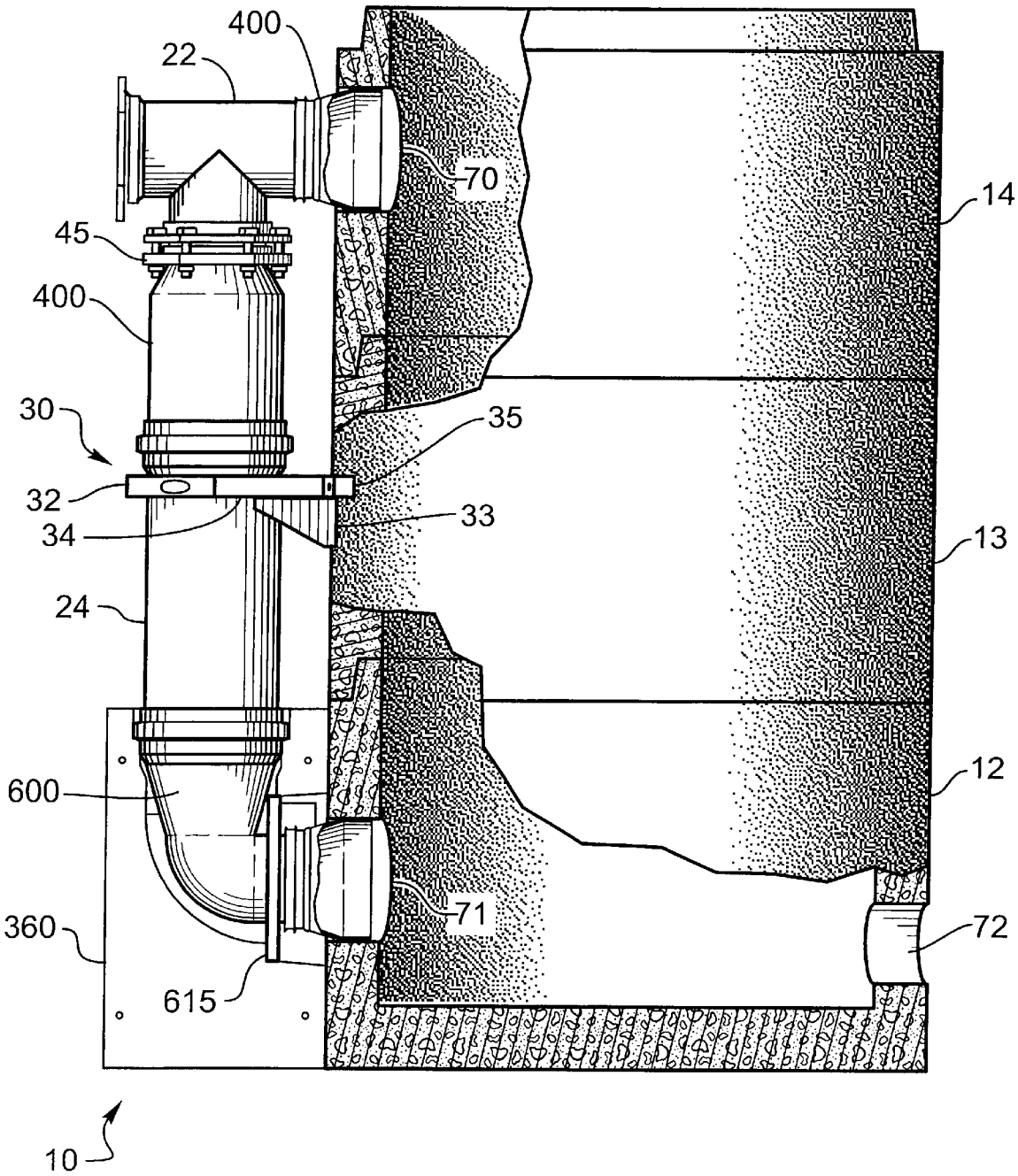
FIG. 22 is a side view of a manhole with an outside drop having an expansion adaptive riser a reduction adaptive elbow and a protective collar.

At construction sites there may be different sized pipes leading to the manhole 10 at apertures 71 and 73 as shown in FIGS. 15, 16 and 22. Alternatively the manholes 10 may come with different sized apertures 71 and 73. In order to efficiently produce and stock only one diameter inside wall 370 for the protective risers 350, 352, 354, 356 for fitting all size manholes 10, and for all pipe sizes leading to apertures 71, 73, adaptors 400 and 410 are used for the T connectors and adaptors 600 and 610 are used for the elbow connectors.

Figure 17:
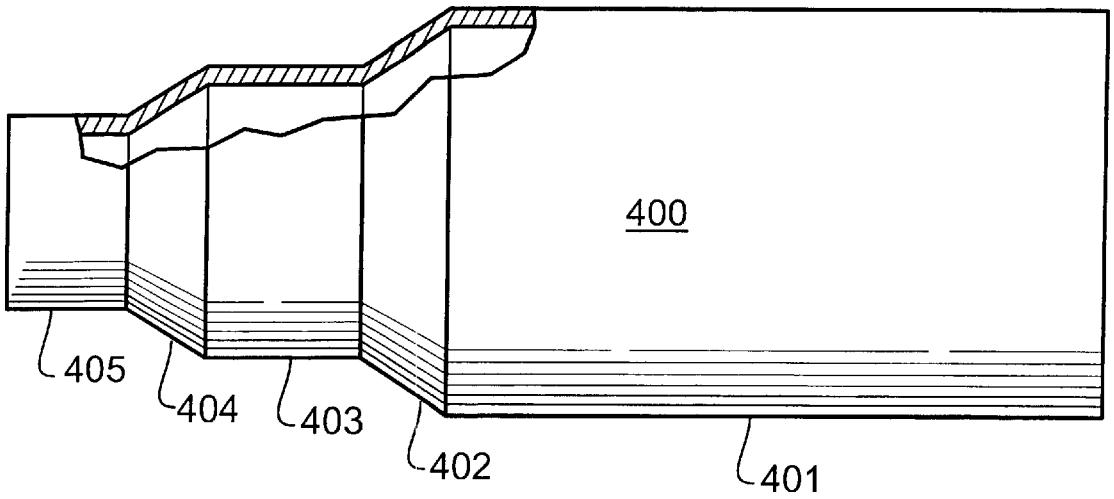
FIG. 17 is a side view of an expanding T adaptor connection.

As shown in FIG. 17 an expander T connection adaptor 400 is shown having a wall 401 of a first diameter, and a first angled outer wall portion 402 leading to a wall of a second diameter 403 of a smaller diameter, a second angled outer wall portion 404 leading to a wall of a third diameter 405. The expander T connection adaptor 400 can be cut at any point long the wall sections 401, 403 or 405 to fit the length of the required gap between the riser 24 and the T connector 22.

Figure 18:
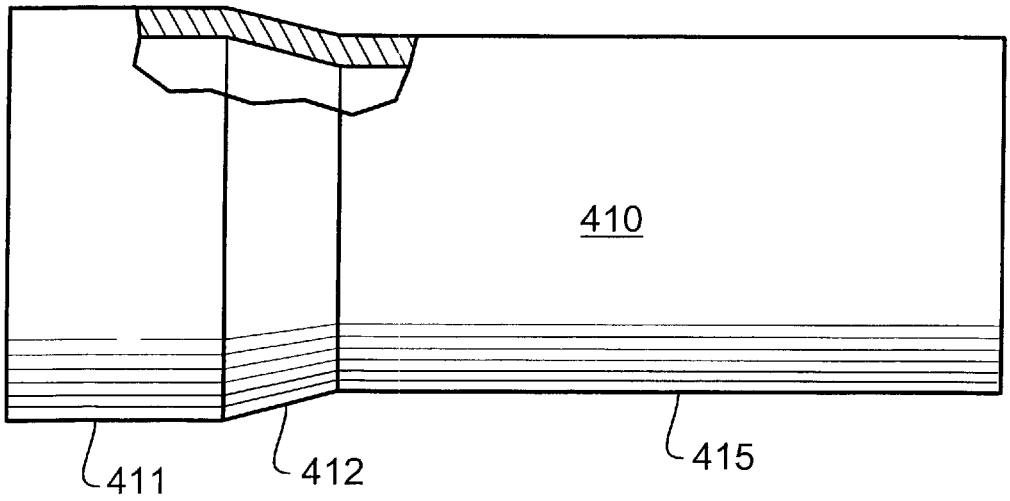
FIG. 18 is a side view of a reducing T adaptor connection.

Similarly a reducer T connection adaptor 410 as shown in FIG. 18 can be used to connect the T connector 22 and the riser 24. The reducer T connection adaptor 410 has a large diameter wall 411 an angled wall 412 and a second diameter wall 415 for connection to riser. The reducer T connection adaptor 410 may be cut at any position along the walls 411 or 415 to fit the length of the required gap between the riser 24 and the T connector 22.

Figure 19:
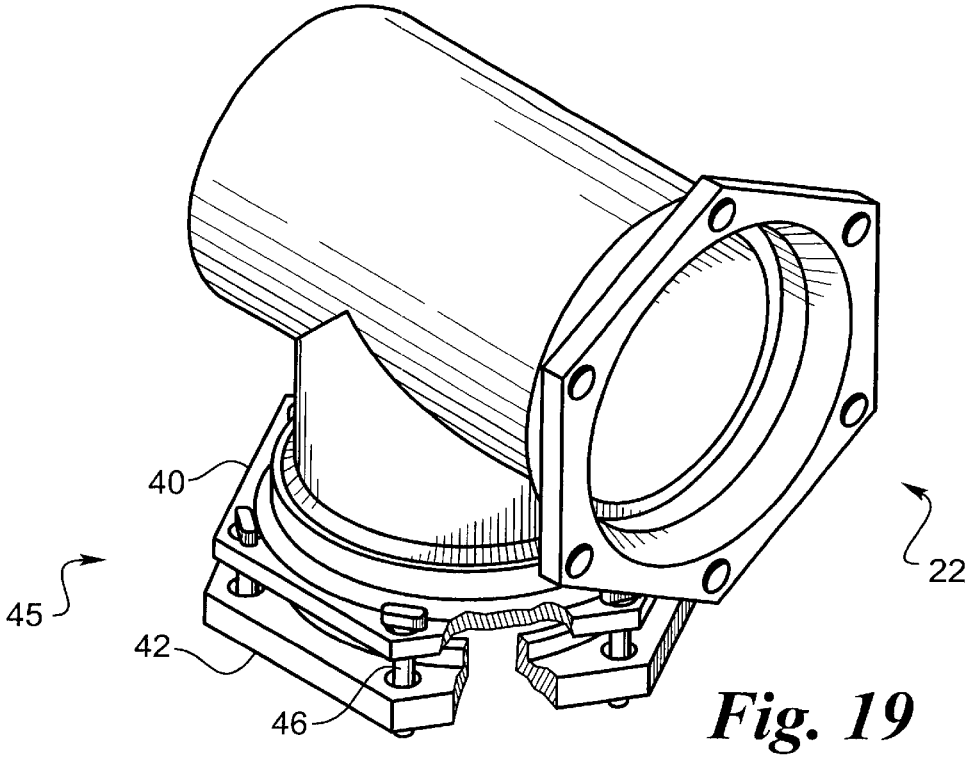
FIG. 19 is a side view of a T collar connector.

The pipe connections between sections of pipes may use a collar connector 45 to connect a flange 40 on one pipe to a flange 42 on another pipe. The connector collar 45 has bolts 46 to pull the flanges 40 and 42 into contact as shown in FIG. 19.

Figure 20:
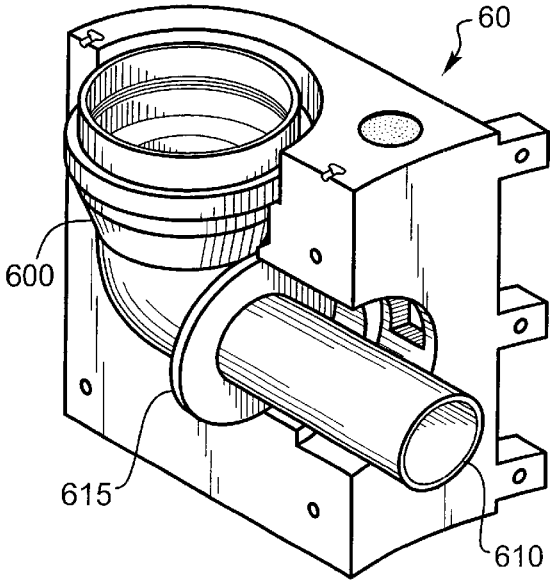
FIG. 20 is a perspective view of an elbow collar with an elbow pipe and elbow reduction adaptor.
Figure 21:
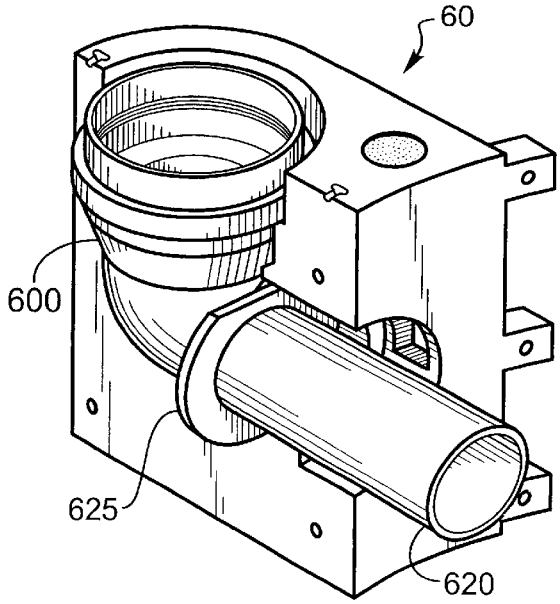
FIG. 21 is a perspective view of an elbow collar with an elbow pipe and elbow expansion adaptor.

Elbow pipe section 600 as shown in FIGS. 20 and 21 may have a reducer 610 or an expander 620 for connecting the elbow section 600 to the manhole 10 at aperture 71.

The elbow pipe 600 may be a pipe in elbow collar 60 or alternatively may be integrally part of the elbow collar 360 as seen in FIG. 12. In either case a reducer 610 or an expander 620 may be attached to direct the flow of fluids into manhole 10. In the case of reducer 600 a collar 615 can be used to help align and hold the reducer 600 in place. Alternatively expander 610 a collar 625 can help align and hold the expander 610 in place.

In the embodiment shown in FIG. 22 a T connector pipe 22 uses an expander 400 to attach it to the manhole 10 at aperture 71. A collar connector 45 connects the T connector 22 to expander 400, which connects to riser 24 having a collar 32 around it to hold the riser 24 to manhole 10. The riser 24 connects to a pipe 600 having a collar 625 an expander 610 in elbow collar 360.

The connections between pipes and between pipes and between pipes and manholes can be any of the types of connections used in the industry.

The collars can be made from polyethylene, polypropylene, fiberglass or any other lightweight strong material. Preferably the collars will be molded for low cost production.

Obviously, many modifications and variations of the present invention are possible in light of the above teachings. It is therefore to be understood that, within the scope of the appended claims, the invention may be practiced otherwise than as specifically described.

What is claimed is:

1. A pipe collar for an outside drop manhole comprising:

an attachment wall having a curved surface of a first diameter for mating with the curved surface of a manhole wall, a first wall attached to and extending away from the manhole at either end of the attachment wall, a tab wall attached to each first wall, having a curved surface of a second diameter, axially extending from the first wall along a portion of the attachment wall to form a tab on the collar, a side wall extending from each tab wall away from the manhole, an end wall connected to the side walls, a top wall connected to and covering the top of the walls, a bottom wall connected to and covering the bottom of the walls, a circular wall extending between the top wall and at least one of the bottom wall and attachment wall, an aperture in the top and the least one of the bottom wall and attachment wall to expose the circular wall, a cylindrical wall extending between the tab walls and the attachment wall and an aperture therethrough to form bolt holes for attaching the collar to the manhole with bolts.

2. A pipe collar for an outside drop manhole as in claim 1 wherein, the least one of the bottom wall and attachment wall the circular wall extends between is the attachment wall to form an elbow collar.

3. A pipe collar for an outside drop manhole as in claim 2 wherein, an aperture in the side wall allows access to the pipe inside to a boot clamp.

4. A pipe collar for an outside drop manhole as in claim 1 wherein, the collar is split in half radially from the center of the attachment wall through the axis of the center of the circular wall, a means for attaching the two halves of the collar to each other to surround a pipe therein.

5. A pipe collar for an outside drop manhole as in claim 4 wherein, a portion of the circular walls on at least one of the top or bottom wall has a portion of the circular wall with a larger radius to permit the collar to close around a pipe coupler between two sections of pipe.

6. A pipe collar for an outside drop manhole as in claim 1 wherein, the collar is split on a line perpendicular to a radial line from the center of the attachment wall and through the axis of the center of the circular wall, a means for attaching the two halves of the collar to each other to surround a pipe therein.

7. A pipe collar for an outside drop manhole as in claim 6 wherein, a portion of the circular walls on at least one of the top or bottom wall has a portion of the circular wall with a larger radius to permit the collar to close around a pipe coupler between two sections of pipe.

8. A pipe collar for an outside drop manhole as in claim 1 wherein, a connection means on the top wall for connecting to a bottom wall of an adjacent collar, such that collars can be stacked.

9. A pipe collar for an outside drop manhole as in claim 8 wherein, the bottom wall has a connection means for connecting to a top wall of an adjacent collar, such that collars can be stacked.

10. A pipe collar for an outside drop manhole as in claim 1 wherein, a connection means on the bottom wall for connecting to a top wall of an adjacent collar, such that collars can be stacked.

11. A pipe collar for an outside drop manhole as in claim 1 wherein, the collars are fluidly connected to adjacent collars such that fluids can flow within the circular walls without leaking.

12. A pipe collar for an outside drop manhole as in claim 11, wherein, an O-ring groove around the circular walls in at least one of the top wall and bottom wall of the collar, an O-ring inserted in the grooves between adjacent collars to prevent leaks between the collars.

13. A pipe collar for an outside drop manhole as in claim 11 wherein, the top wall of one collar section is connected to a T pipe at the top of the manhole and the attachment wall of an elbow collar is attached to a pipe at the bottom of the manhole.

14. A pipe collar for an outside drop manhole as in claim 1 wherein, the circular walls have a uniform diameter.

15. A pipe collar for an outside drop manhole as in claim 1 wherein, the circular walls have a changing diameter to form one of either an expander collar or a reducer collar.

16. A pipe collar for an outside drop manhole as in claim 1 wherein, tubes extending between the top and bottom walls provide strength for the collar.

17. A pipe collar for an outside drop manhole as in claim 1 wherein, the least one of the bottom wall and attachment wall the circular wall extends between is the bottom wall to form a riser collar.

18. A pipe collar for an outside drop manhole as in claim 17 wherein, a support portion attached to the bottom wall having a wall section for engaging the manhole and providing stability for the collar.

19. A pipe collar for an outside drop manhole as in claim 1 wherein, tubes extending between the circular walls and side walls provide strength for the collar.

20. A pipe collar for an outside drop manhole as in claim 1 wherein, tubes extending between the circular walls and side walls provide strength for the collar.

21. A pipe collar for an outside drop manhole as in claim 1 wherein, tubes extending between the circular walls and attachment walls provide strength for the collar.

22. A pipe collar for an outside drop manhole as in claim 1 wherein, tubes extending between the side walls provide strength for the collar.

23. A pipe collar for an outside drop manhole as in claim 1 wherein, an aperture in the top wall allows material to be placed inside the collar for strength.

24. A pipe collar for an outside drop manhole as in claim 1 wherein, an aperture in the side wall allows water to flow therethrough.

* * * * *